US005676064A

United States Patent [19]

Shuert

[11] Patent Number: 5,676,064

[45] Date of Patent: Oct. 14, 1997

[54] PALLET AND PALLET PACKAGE

[76] Inventor: Lyle H. Shuert, 70 Kingsley Manor Dr., Bloomfield Hills, Mich. 48304

[21] Appl. No.: 642,243

[22] Filed: Apr. 24, 1996

Related U.S. Application Data

[63] Continuation-in-part of Ser. No. 636,062, Apr. 22, 1996.

[51] Int. Cl.[6] ..... B65D 19/00

[52] U.S. Cl. ..... 108/51.1; 108/55.1; 108/901

[58] Field of Search ..... 108/901, 902, 108/51.1, 55.1

[56] References Cited

U.S. PATENT DOCUMENTS

| | | | |
|---|---|---|---|
| 2,486,284 | 10/1949 | Horwitz . | |
| 2,670,501 | 3/1954 | Michiels . | |
| 3,467,032 | 9/1969 | Rowlands et al. . | |
| 3,604,368 | 9/1971 | Baxter . | |
| 3,610,173 | 10/1971 | McIlwraith et al. . | |
| 3,664,271 | 5/1972 | Wolder et al. . | |
| 3,667,403 | 6/1972 | Angelbeck, Jr. . | |
| 3,680,496 | 8/1972 | Westlake, Jr. . | |
| 3,691,964 | 9/1972 | Larson et al. . | |
| 3,697,029 | 10/1972 | Lauffer . | |
| 3,699,902 | 10/1972 | Allgeyer et al. . | |
| 3,788,462 | 1/1974 | Meincer . | |
| 3,853,218 | 12/1974 | Grasvoll . | |
| 3,884,935 | 5/1975 | Burns, III . | |
| 3,986,611 | 10/1976 | Dreher . | |
| 4,428,306 | 1/1984 | Dresen et al. | 108/53.3 |
| 4,550,830 | 11/1985 | Shuert | 206/386 |
| 4,809,618 | 3/1989 | Bell | 108/901 X |
| 4,856,657 | 8/1989 | Shuert | 206/600 |
| 4,879,956 | 11/1989 | Shuert | 108/53.3 |
| 4,886,694 | 12/1989 | Donnard | 108/55.3 X |
| 5,117,762 | 6/1992 | Shuert | 108/51.1 |
| 5,249,699 | 10/1993 | Williams | 108/51.1 X |
| 5,255,613 | 10/1993 | Shuert | 108/52.1 |
| 5,279,423 | 1/1994 | Shuert | 206/600 |

FOREIGN PATENT DOCUMENTS

| | | |
|---|---|---|
| 226505 | 6/1987 | European Pat. Off. . |
| 2206248 | 6/1974 | France . |

*Primary Examiner*—Jose V. Chen
*Attorney, Agent, or Firm*—Young & Basile, P.C.

[57] ABSTRACT

A plastic pallet and a method of shrink-wrapping an article onto the platform structure of the pallet. The pallet includes a plurality of legs and a planar platform structure supported by the legs and formed of upper and lower thermoformed sheets of plastic selectively fused together. The upper and lower sheets are maintained in vertically spaced parallel relation in a central portion of the platform structure and peripheral edges of the upper and lower sheets are fused together to define a downwardly extending peripheral lip defining a downwardly opening groove extending around the periphery of the platform structure outboard of the legs. The peripheral lip improves the stiffness and the side impact resistance of the platform structure and the groove facilitates the shrink-wrapping of an article onto the pallet. Specifically, an article is placed on the platform structure and the article is shrink-wrapped onto the platform structure utilizing a plastic film sheet by placing the film sheet in covering relation over the article and tucking a lower edge portion of the film sheet into the downwardly opening groove.

6 Claims, 6 Drawing Sheets

PALLET AND PALLET PACKAGE

RELATED APPLICATION

This application is a continuation-in-part of U.S. patent application Ser. No. 8-636,062 filed on Apr. 22, 1996.

BACKGROUND OF THE INVENTION

This invention relates to pallets and more particularly to a pallet configured to facilitate a pallet package.

Pallets have traditionally been formed of wood. Wood pallets, however, have many disadvantages. For example, they are subject to breakage and thus are not reusable over an extended period of time. In an effort to solve some of the problems associated with wood pallets, plastic pallets have been developed and employed with some degree of success. In one generally successful form of plastic pallet design, upper and lower plastic sheets are formed in separate molding operations and the two sheets are then selectively fused or knitted together in a suitable press to form reinforced double wall or "twin sheet" structures.

Plastic twin sheet pallets of this general type are shown, for example, in U.S. patent Nos. 4,550,830; 4,606,278; 4,742,781; 4,765,252; 4,856,657; 4,879,956; 4,936,451; 4,989,731; 5,042,396; 5,117,762; 5,133,460; 5,255,613; 5,390,467; 5,401,347; 5,404,829; and 5,279,423 all invented by the inventor of the present application. Whereas the twin sheet plastic pallets disclosed in these patents have been generally satisfactory, they do not in some severe service environments provide sufficient side impact protection or sufficient stiffness and they do not lend themselves to use in the formation of shrink-wrapped package in which an article is positioned on a pallet and a film of plastic shrink-wrap material is positioned over the article and secured to the pallet.

SUMMARY OF THE INVENTION

This invention is directed to the provision of an improved twin sheet plastic pallet.

More specifically this invention is directed to the provision of a twin sheet plastic pallet having improved side impact protection and improved stiffness.

Yet more specifically, this invention is directed to the provision of twin sheet plastic pallets especially suitable for use in shrink-wrapping articles carried by the pallet.

The invention pallet is of the type including a plurality of legs and a planar platform structure supported by the legs and formed of upper and lower thermoformed sheets of plastic selectively fused together to form a twin sheet structure. According to the invention, the upper and lower sheets are maintained in vertically spaced parallel relation in a central portion of the platform structure and peripheral edges of the upper and lower sheets are fused together to define a downwardly extending peripheral lip defining a downwardly opening groove extending around the periphery of the platform structure. This construction significantly improves the side impact resistance and the stiffness of the platform structure and facilitates the use of a shrink-wrapped plastic film in conjunction with articles supported by the pallet by enabling the lower peripheral edge of the plastic shrink-wrap sheet to be tucked into the groove.

According to a further feature of the invention, the legs are positioned in circumferentially spaced relation around the periphery of the platform structure and each includes an outboard surface, and the groove extends around the periphery of the platform structure outside of the legs and in outwardly spaced relation to the outboard surfaces of the legs. This specific arrangement provides a continuous groove around the entire periphery of the platform structure to facilitate tucking of the shrink-wrap film and improve the stiffness and side impact characteristics of the platform structure.

According to a further feature of the invention, the lip is formed by bringing the peripheral edge portion of the lower sheet upwardly into proximity with the peripheral edge portion of the upper sheet and bending the sheets downwardly together. This specific construction facilitates the provision of the downwardly extending groove in a twin sheet construction.

The invention also provides a method of forming a plastic pallet of the type including a platform structure and a plurality of circumferentially spaced legs extending downwardly from the platform structure. According to the invention method, upper and lower plastic sheets are thermoformed; central main body portions of the sheets are selectively fused together to form a central platform structure for the pallet; and peripheral edge portions of the sheets are fused together to form a downwardly extending peripheral lip defining a downwardly opening groove proximate the periphery of the platform structure. This specific methodology allows the ready construction of a twin sheet pallet providing a downwardly opening groove to facilitate shrink-wrapping of articles positioned on the platform and improve the stiffness and side impact characteristics of the platform structure.

The invention also provides a method of packaging an article on a pallet. According to the invention packaging method, a pallet is formed by thermoforming upper and lower plastic sheets, selectively fusing central main body portions of the sheets together to form a platform structure, fusing peripheral edge portions of the sheets together to form a downwardly opening groove extending around the periphery of the platform structure, and providing a plurality of circumferentially spaced legs extending downwardly from the platform structure within the grooves; the article is placed on the platform structure; and the article is shrink-wrapped on the platform structure, utilizing a plastic film sheet, by placing the film sheet in covering relation over the article and tucking a lower edge of the film sheet into the downwardly opening groove. This specific packaging methodology allows the ready and convenient shrink-wrapping of an article positioned on the pallet.

DETAILED DESCRIPTION OF THE PREFERRED EMBODIMENT

Figure 1:
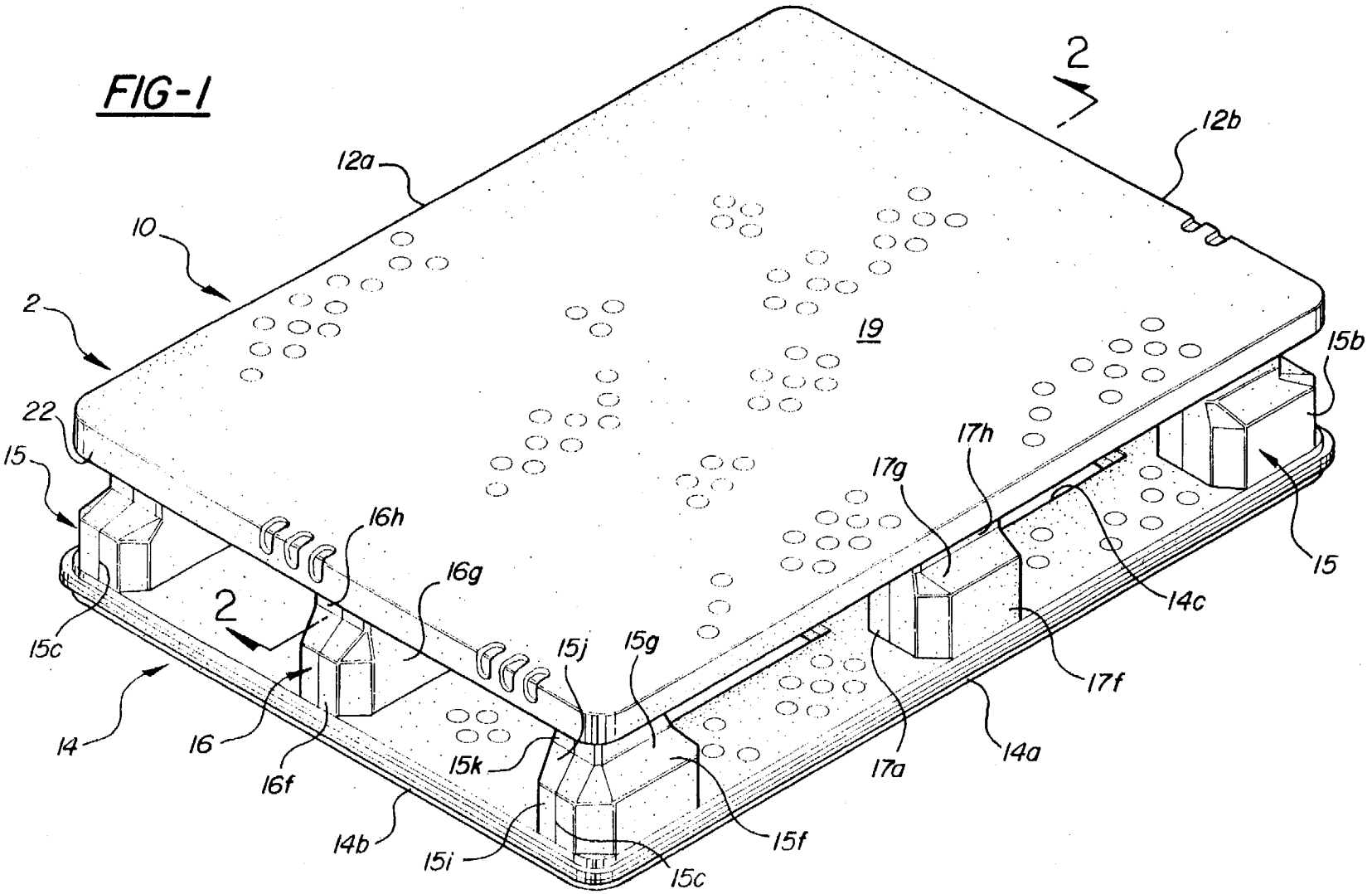
FIG. 1 is a perspective view of a twin sheet plastic pallet according to the invention including a base structure, a platform structure, and a plurality of legs interposed between the base and platform structures.
Figure 2:
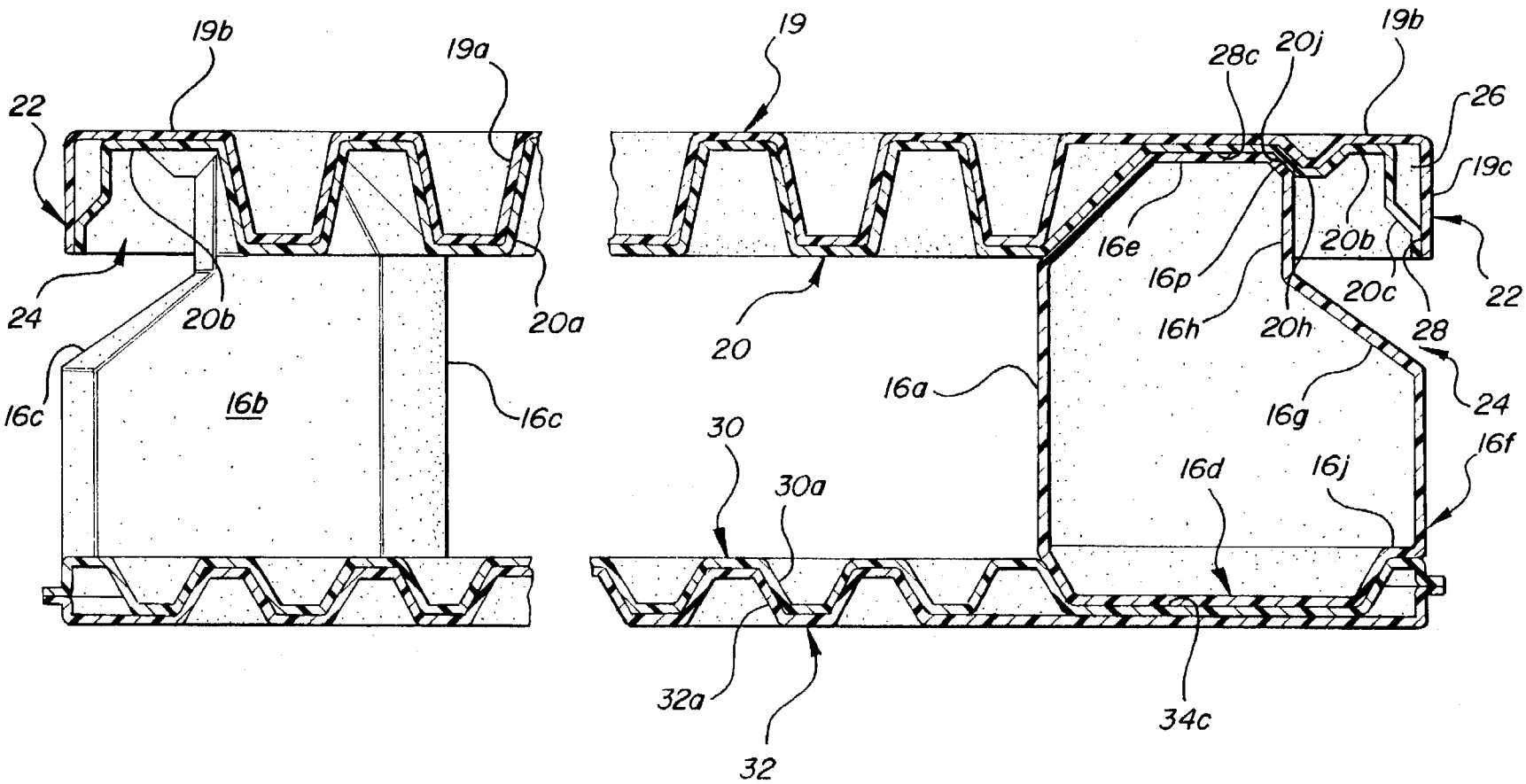
FIG. 2 is a fragmentary cross-sectional view taken on line 2—2 of FIG. 1.
Figure 3:
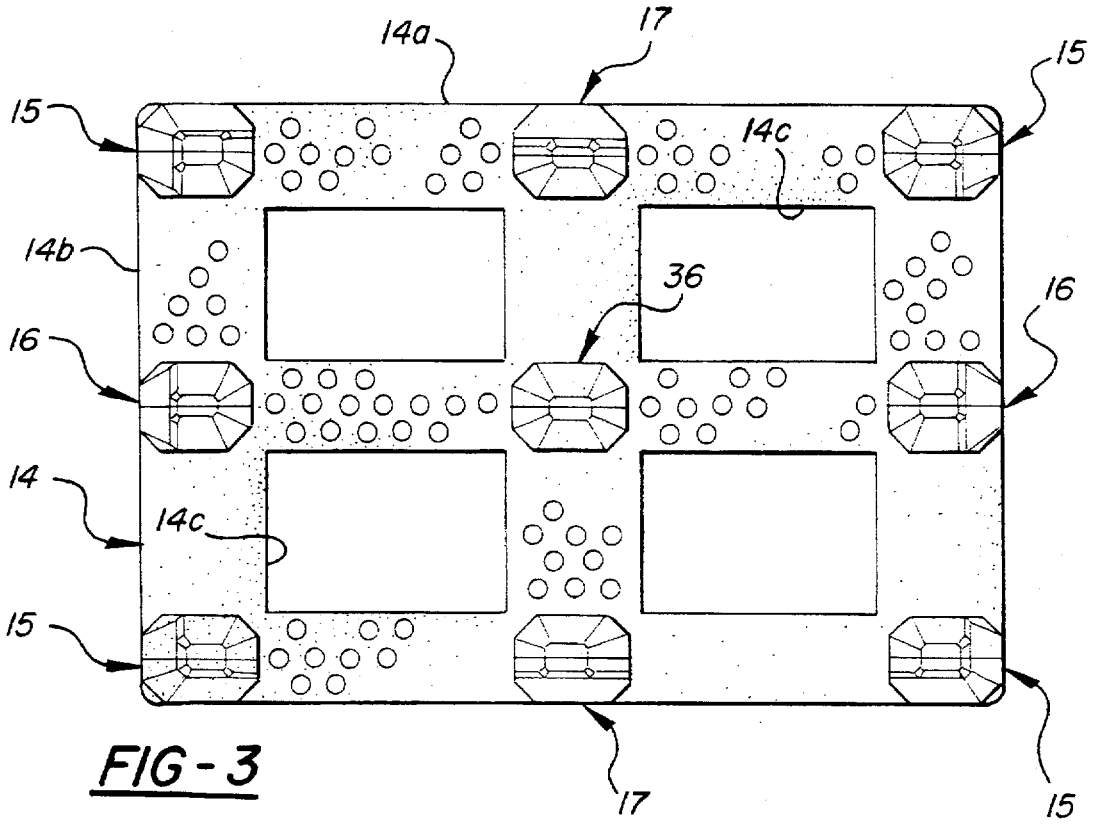
FIG. 3 is a plan view of the pallet with the platform structure removed.
Figure 4:
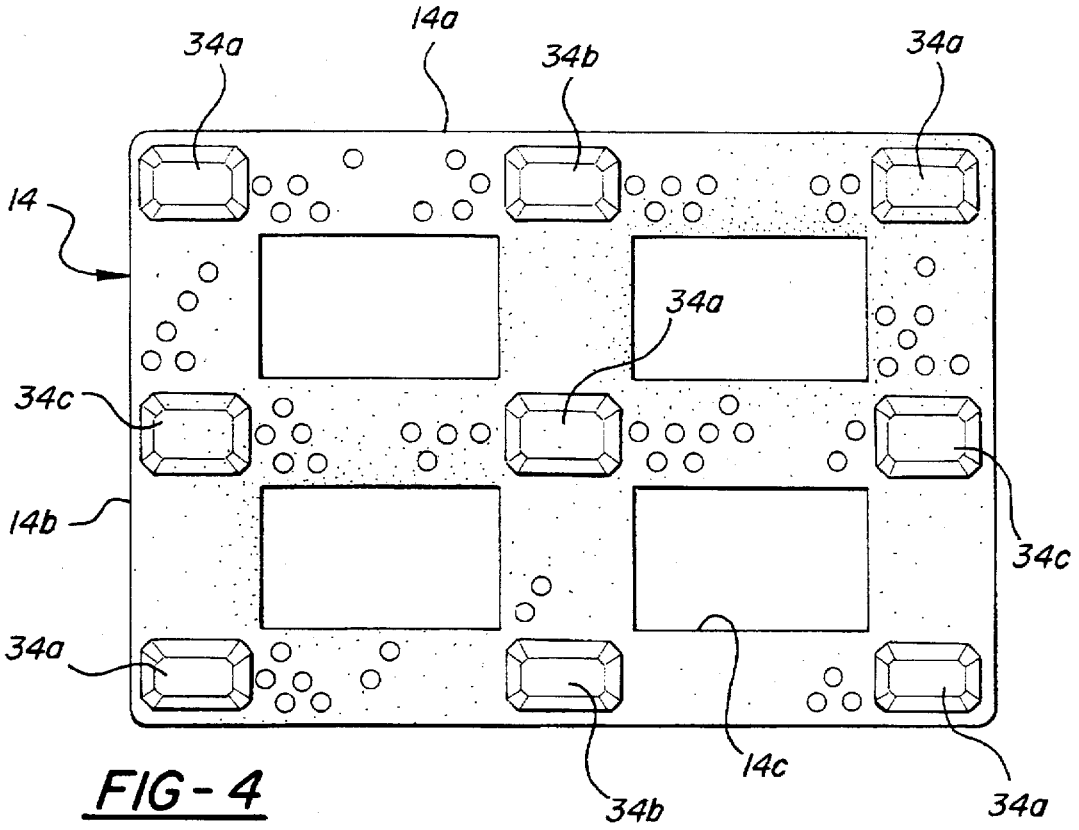
FIG. 4 is a plan view of the pallet with the legs also removed.
Figure 5:
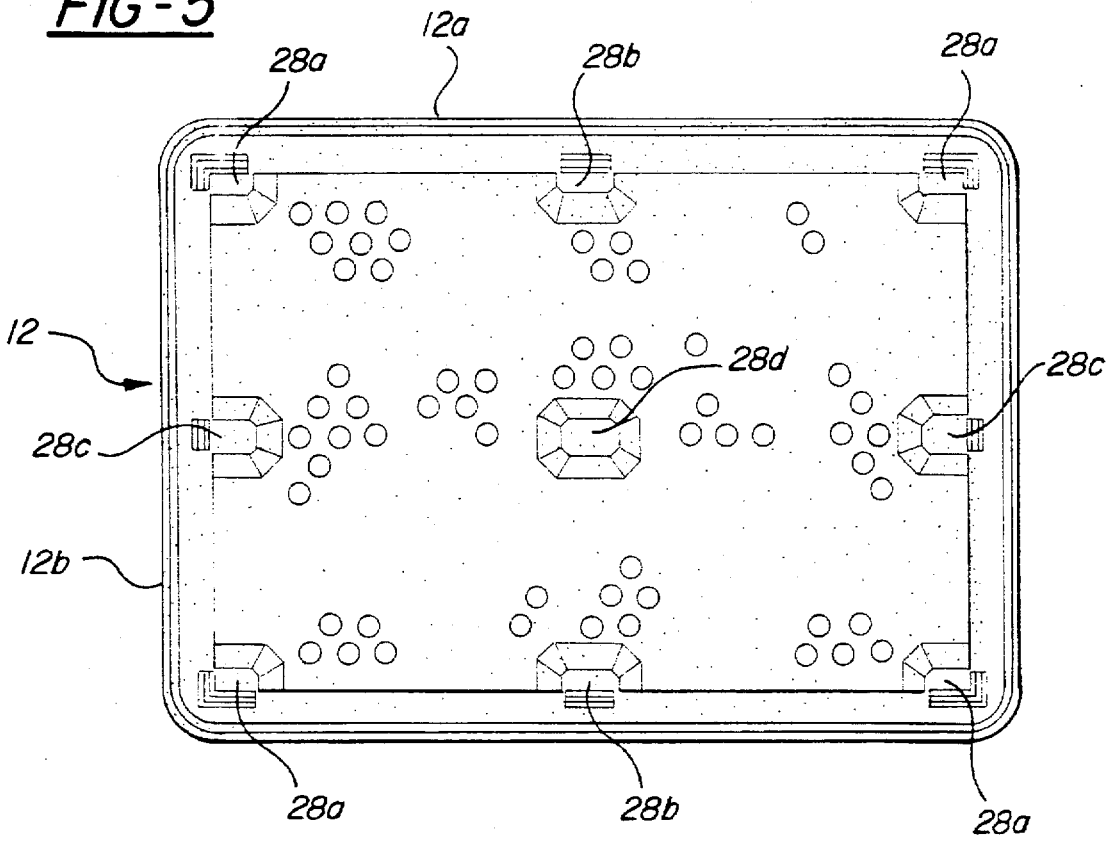
FIG. 5 is a bottom plan view of the platform structure.

The pallet 10 seen in FIG. 1 is a double faced pallet of twin sheet construction. Specifically, pallet 10 includes an upper platform structure 12, a lower base structure 14, and a plurality of modular legs 15, 16, 17, and 18 interconnecting the platform structure and base structure. Platform structure 12, base structure 14, and legs 15–18 are formed of organic polymeric material such as polyethylene. Platform structure 12 and base structure 14 preferably are of a twin sheet construction employing two plastic sheets which are vacuum formed and fused or knitted together at various points to add structural rigidity.

Platform structure 12 is formed of an upper plastic sheet 19 and a lower plastic sheet 20. Upper sheet 19 has a series of rows of downwardly extending bosses 19*a* and lower sheet 20 has a series of rows of upwardly extending bosses 20*a*. The downwardly extending and upwardly extending rows of bosses are arranged in interdigitated fashion and fused together at the interface of the interdigitated bosses to form rows of boss columns. The rows of columns may for example extend parallel to the longitudinal and transverse side edges 12*a*, 12*b* of the platform structure. Further details of the manner in which the bosses of the upper and lower sheets are fused together to form the column structures are shown in U.S. Pat. Nos. 5,390,467, 5,401,347 and 5,470,641.

The peripheral edges 19*b* and 20*b* of the upper and lower sheets are fused together to define a downwardly extending peripheral lip 22 defining a downwardly opening groove 24 extending totally around the periphery of the platform structure. Lip 22 is formed by bringing peripheral edge portion 20*b* of the lower sheet upwardly into proximity with the peripheral edge portion 19*b* of the lower sheet and bending the sheet edge portions downwardly together. Lip 22 is constituted by a downwardly extending outer edge portion 20*c* of lower sheet 20 and a downwardly extending outer edge portion 19*c* of upper sheet 19. Edge portions 19*c*, 20*c* are selectively spaced apart proximate their upper regions to define circumferentially spaced voids 26 therebetween for structural rigidity and are continuously fused together adjacent their lower regions at an interface 28. Peripheral lip 22 will be seen to significantly improve the stiffness of the platform structure, especially along the peripheral edges of the platform structure, and will further be seen to significantly improve the ability of the platform structure to withstand continuous and severe side impact blows to the peripheral edges of the platform structure.

Upper and lower sheets 19, 20 are also configured at circumferentially spaced locations around the periphery of the platform structure to define downwardly opening recesses or pockets 28 to receive respective legs 15, 16, 17, and 18. Specifically, corner pockets 28*a* are defined at each corner of the platform structure; longitudinal side pockets 28*b* are defined along each longitudinal side edge 12*a* of the platform structure; lateral side edge pockets 28*c* are defined along each lateral side edge 12*b* of the platform structure; and a central pocket 28*d* is defined in a central portion of the platform structure.

Base structure 14 is formed of upper and lower plastic sheets 30, 32 respectively defining downwardly extending rows of bosses 30*a* and upwardly extending rows of bosses 32*a* which are interdigitally arranged and fused together at their interdigitated interfaces to form rows of columns similar to the rows of columns in the platform structure. Base structure 14 may comprise a single, continuous structure or may, as shown, include cutouts 14*c* to give the base structure an open grate configuration.

Upper and lower sheets 30 and 32 are further configured to define upwardly opening recesses or pockets 34 corresponding in number and circumferential disposition to the downwardly opening pockets 28 in the platform structure and arranged to receive the lower ends of legs 15–18. Specifically, corner pockets 34*a* are defined at each corner of the base structure; longitudinal side pockets 34*b* are defined along each longitudinal side edge 14*a* of the base structure; lateral side pockets 34*c* are defined along each lateral side edge 14*b* of the base structure; and a central pocket 34*d* is defined in a central region of the base structure.

Legs 15–18 are of a modular closed box construction and each includes a left half 15*a*, 16*a*, 17*a*, and 18*a* and a right half 15*b*, 16*b*, 17*b* and 18*b* fused together along a respective fuse or seam line 15*c*, 16*c*, 17*c*, and 18*c*. The lower end of each leg 15 is configured to nest within a respective base structure pocket 34*a*; the upper end of each leg 15 is configured to nest or seat within a respective platform structure corner pocket 28*a*; the lower end of each leg 16 is configured to nest within a respective base structure lateral side edge pocket 34*c*; the upper end of each leg 16 is configured to nest within a respective platform structure lateral side edge pocket 28*c*; the lower end of each leg 17 is configured to nest within a respective base structure lateral side edge pocket 34*b*; the upper end of each leg 17 is configured to nest within a respective platform structure lateral side edge pocket 28*b*; and the upper and lower ends of leg 18 are configured to seat respectively in pockets 28*d*, 34*d*.

The outboard wall 16i fof each leg 16 is stepped inwardly at 16*g* to define a recessed upper wall portion 16*h* which is stepped inwardly with respect to lip 22 so as not to encroach upon groove 24 and not to interfere with access to groove 24. The outboard wall 17*f* of each leg 17 is stepped inwardly at 17*g* to define a recessed upper wall portion 17*h* which is stepped inwardly with respect to lip 22 so as not to encroach upon groove 24 and so as not to interfere with access to groove 24. The longitudinal outboard face 15*f* of each leg 15 is stepped inwardly at 15*g* to define an upper recessed wall portion 15*h* spaced inwardly from lip 22 and the transverse outboard face 15*i* of each leg 15 is stepped inwardly at 15*j* to define a recessed upper wall portion 15*k* spaced inwardly with respect to lip 22. Central leg 18 extends between central pockets 28*d* and 38*d* to support the central region of the pallet. The upper ends of the legs 15, 16, 17, and 18 are fused in position within the respective upper pockets 28 and the lower ends of the legs 15, 16, 17, and 18 are fused in position in the respective lower pockets 34. The inwardly stepped configuration of the legs will be seen to avoid encroachment of the upper ends of the legs with groove 24 so as to not impede access to the groove 24 at any point around the circumference of the platform structure.

Figure 8:
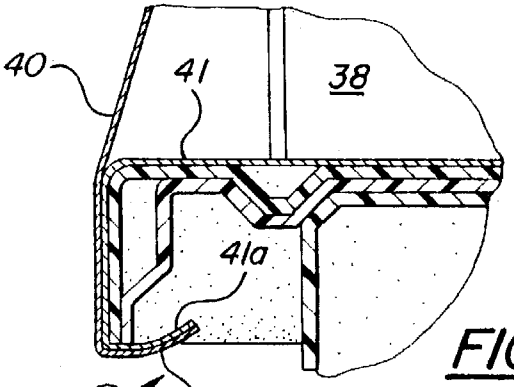
FIG. 8 is a detail view taken within circle 8 of FIG. 9.
Figure 7:
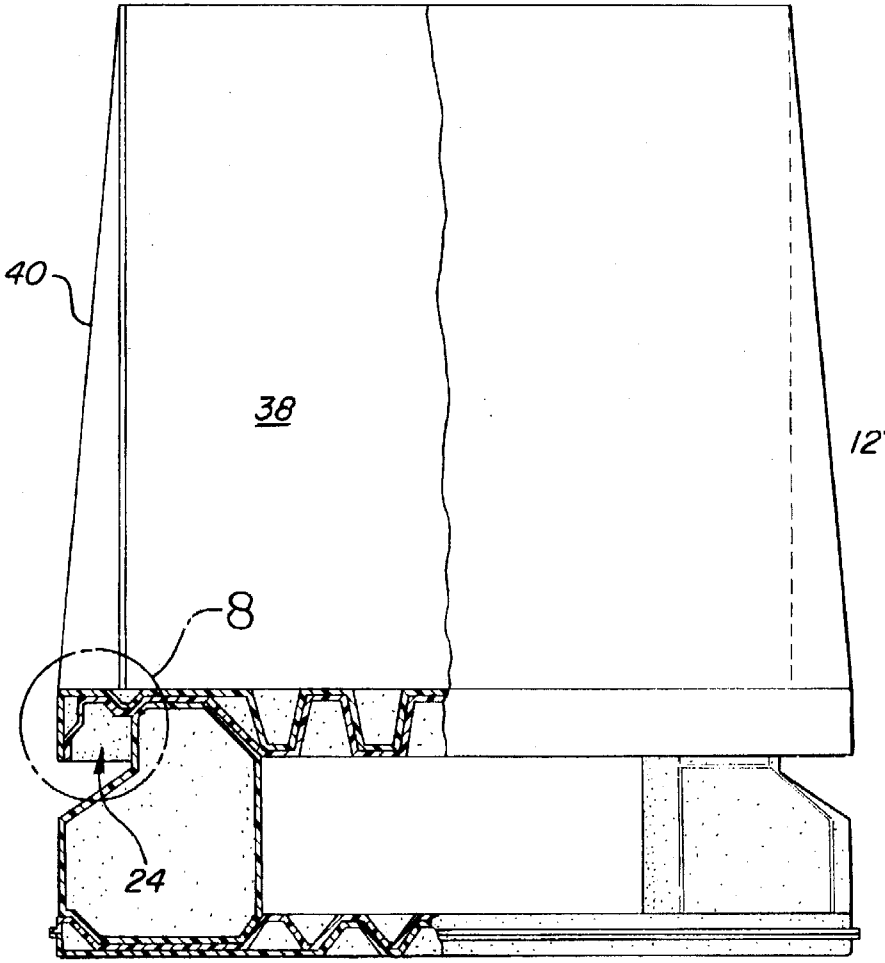
FIG. 7 is a side elevational view showing the utilization of the invention pallet in a shrink-wrapping methodology.

FIGS. 7 and 8 illustrate the manner in which the invention pallet is utilized to facilitate the shrink-wrapping of an article such as the article 38 positioned on the upper face of the platform structure. Specifically, article 38 is shrink-wrapped in position on the platform structure 12 utilizing a plastic film bag sheet 40 which is positioned in covering relation over the article whereafter its lower peripheral edge 40*a* is tucked into the downwardly opening groove 24 so as to firmly secure the lower edge 40*a* of the film sheet to the platform structure and preclude inadvertent separation of the film sheet from the platform structure and inadvertent exposure of the article. If desired, and as shown in FIG. 8, a flat sanitizing film sheet 41 may be positioned over the platform structure prior to placement of the article 38 on the platform structure, whereafter article 38 may be placed on the platform structure over film sheet 41, bag sheet 40 may be fitted over the article, and the lower peripheral edges 40*a* 41*a* of the bag film and the flat film may be tucked together into the downwardly opening groove 24.

Figure 10:
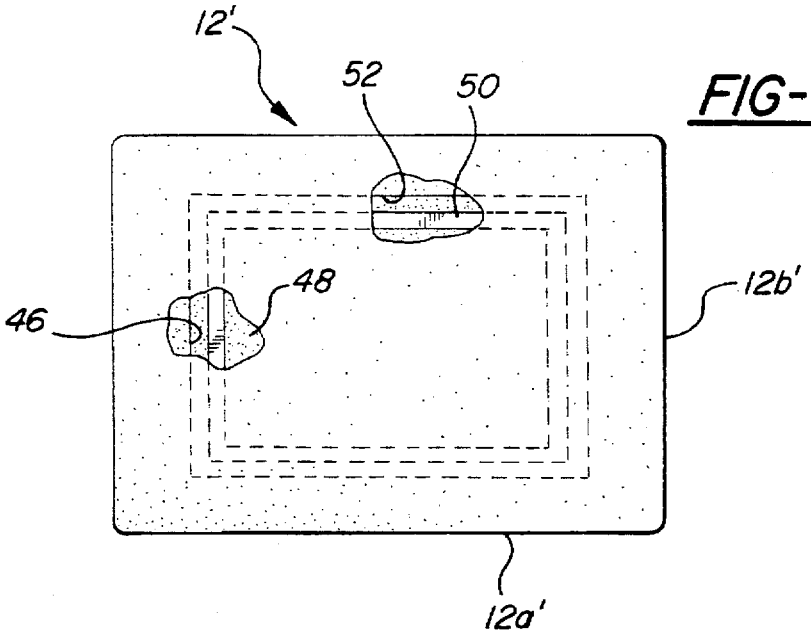
FIG. 10 is a plan view of the modified pallet of FIG. 9.
Figure 6:
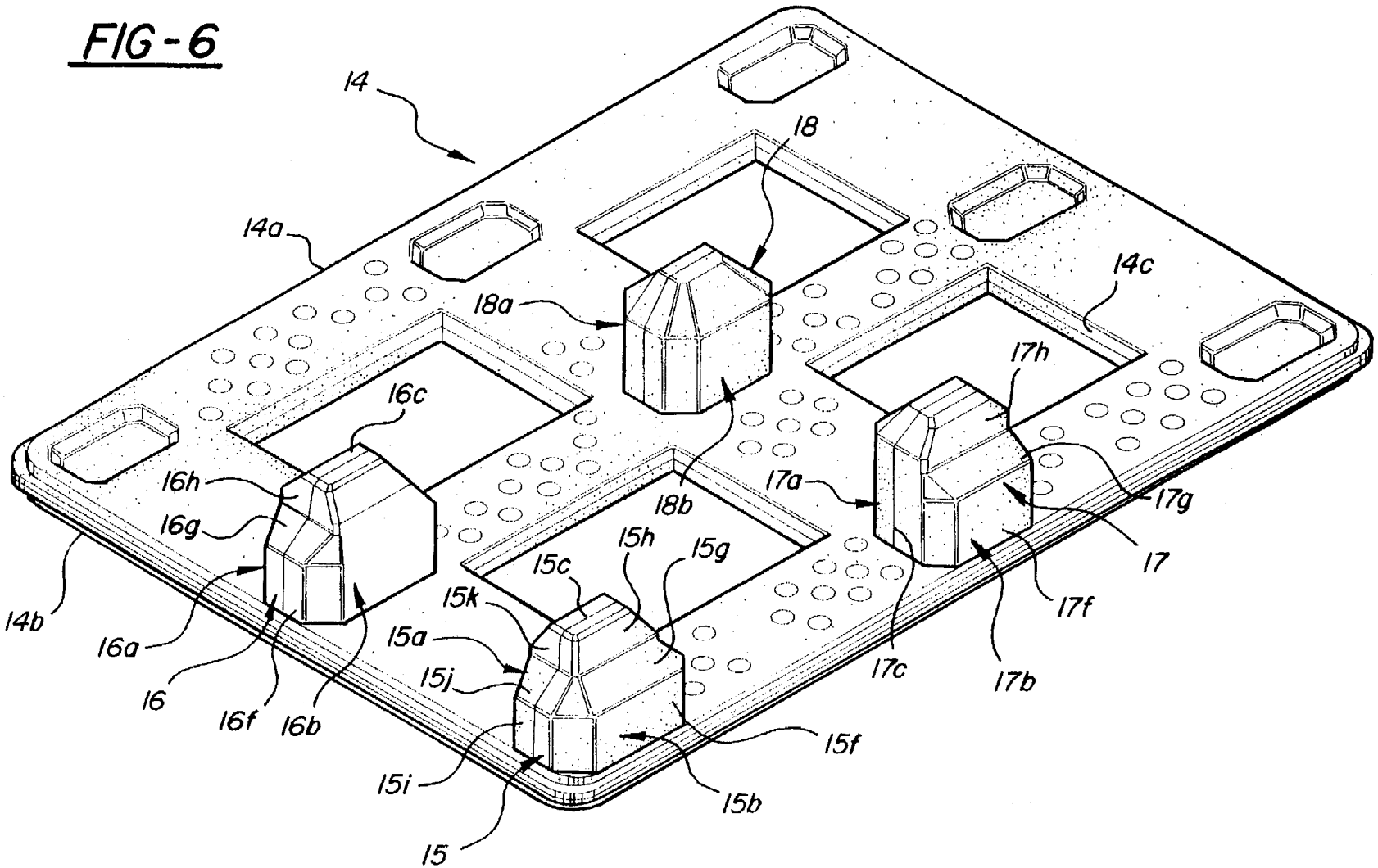
FIG. 6 is s a perspective view showing the base structure and some of the legs.
Figure 9:
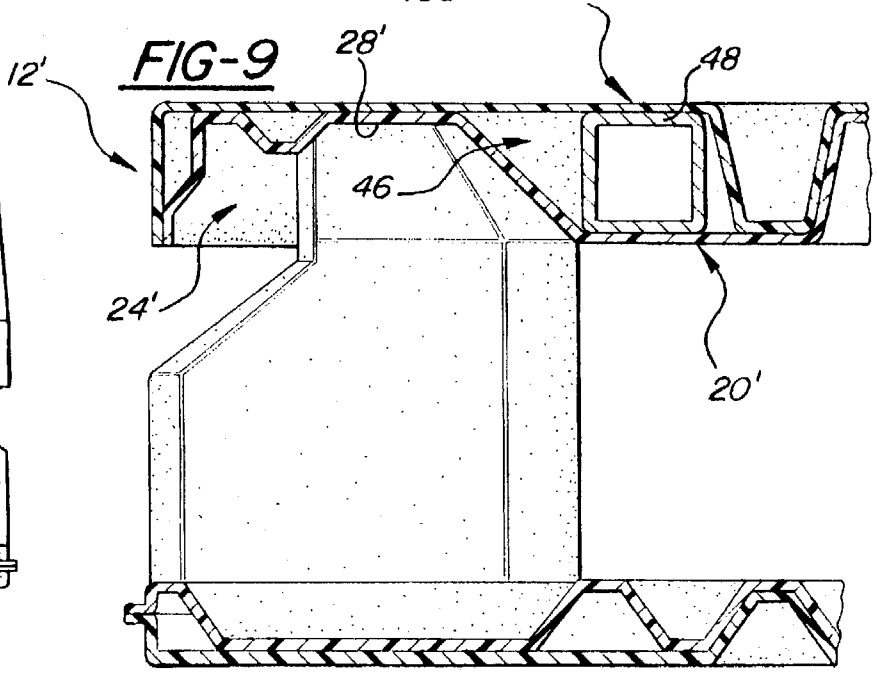
FIG. 9 is a fragmentary detail view showing a modified form of the invention pallet.

In the modified form of the pallet seen in FIGS. 9 and 10, the upper and lower sheets 19' and 20' of the platform structure 12' are configured to define laterally extending cavities 42 positioned inboard of the leg pockets 28' and extending parallel to the platform structure lateral side edges 12*b*', and a tubular steel beam 48 is positioned in each cavity 42 to add structural rigidity to the platform structure and to the pallet. Preferably the upper and lower sheets are further configured to provide longitudinal cavities 50 extending parallel to the platform structure longitudinal side edges 12*a*' inboard of leg pockets 28' and longitudinally extending tubular steel beams 52 are positioned in the cavities 50 so as to coact with the beams 48 to define a rectangular beam structure extending around the perimeter of the platform structure inboard of the legs.

The described platform structure and pallet construction will be seen to significantly enhance the stiffness of the platform structure and the ability of the platform structure to withstand severe and continuous side impact. The invention pallet will further be seen to utilize the well known plastic twin sheet pallet construction in a manner such as to facilitate the shrink-wrapping of articles positioned on the platform structure by allowing the firm, positive positioning of the lower peripheral edge of the shrink-wrapped film sheet within the downwardly opening groove defined by the twin sheet construction.

Whereas preferred embodiments of the invention have been illustrated and described in detail, it will be apparent that various changes may be made in the disclosed embodiments without departing from the scope or spirit of the invention. For example, although the invention pallet has been described as including a downwardly opening groove extending totally around the periphery of the platform structure outside of the pallet legs, the pallet may alternatively be constructed with the legs extending to the outer periphery of the pallet so that the legs interrupt the groove to form a discontinuous groove extending around the periphery of the pallet except for the areas occupied by the legs.

I claim:

1. In a plastic pallet of the type including a plurality of legs and a planar platform structure supported by the legs and formed of upper and lower thermoformed sheets of plastic selectively fused together, the improvement wherein:

the legs are positioned in circumferentially spaced relation around the periphery of the platform structure, extend downwardly from the platform structure, and each includes an outboard surface;

the upper and lower sheets are maintained in vertically spaced parallel relation in a central portion of the platform structure;

peripheral edges of the upper and lower sheets are fused together to define a downwardly extending peripheral lip defining a downwardly opening groove proximate the periphery of the platform structure; and the groove extends around the periphery of the platform structure outside of the legs and in outwardly spaced relation to the outboard surfaces of the legs.

2. A pallet according to claim 1 wherein the lip is formed by bringing the peripheral edge portion of the lower sheet upwardly into proximity with the peripheral edge portion of the upper sheet and bending the sheet edge portions downwardly together.

3. A plastic pallet including:

a planar platform structure; and a plurality of legs positioned in circumferentially spaced relation around the periphery of the platform structure, extending downwardly from the platform structure, and each including an outboard surface;

the planar platform structure being supported by the legs and formed of upper and lower thermoformed sheets of plastic selectively fused together to form a central platform structure, wherein the upper and lower sheets are maintained in vertically spaced parallel relation, and a peripheral platform structure, wherein peripheral edges of the upper and lower sheets are fused together to define a downwardly extending peripheral lip defining a downwardly opening groove extending around the periphery of the platform structure outside of the legs and in outwardly spaced relation to the outboard surfaces of the legs.

4. A pallet according to claim 3 wherein:

each leg comprises a hollow modular structure defining an upper attachment surface; and the upper attachment surface of each leg is fused to a lower attachment surface defined on an under face of the platform structure.

5. A method of forming a plastic pallet of the type including a platform structure and a plurality of circumferentially spaced legs extending downwardly from the platform structure, the method comprising:

thermoforming upper and lower plastic sheets;

selectively fusing central main body portions of the sheets together to form a central platform structure for the pallet;

providing a plurality of circumferentially spaced legs extending downwardly from the platform structure and each including an outboard surface; and fusing peripheral edge portions of the sheets together to form a downwardly extending peripheral lip defining a downwardly opening groove proximate the periphery of the platform structure outside of the legs and in outwardly spaced relation to the outboard surfaces of the legs.

6. A method of packaging an article comprising:

forming a pallet by thermoforming upper and lower plastic sheets, selectively fusing central main body portions of the sheets together to form a platform structure, providing a plurality of circumferentially spaced legs extending downwardly from the platform structure and each including an outboard surface, and fusing peripheral edge portions of the sheets together to form a downwardly extending peripheral lip defining a downwardly opening groove proximate the periphery of the platform structure outside of the legs and in outwardly spaced relation to the outboard surfaces of the legs;

placing the article on the platform structure; and shrink-wrapping the article on the platform structure, utilizing a plastic film sheet, by placing the film sheet in covering relation over the article and tucking a lower edge of the film sheet into the downwardly opening groove.

* * * * *